US009035203B2

(12) United States Patent
Kalayjian et al.

(10) Patent No.: US 9,035,203 B2
(45) Date of Patent: May 19, 2015

(54) ELECTRICAL INTERFACE INTERLOCK SYSTEM

(71) Applicant: Tesla Motors, Inc., Palo Alto, CA (US)

(72) Inventors: Nicholas Robert Kalayjian, San Carlos, CA (US); Ryan Thomas Davis, Mountain View, CA (US); Michael Kaojen Fang, Los Altos, CA (US)

(73) Assignee: Tesla Motors, Inc., Palo Alto, CA (US)

( * ) Notice: Subject to any disclaimer, the term of this patent is extended or adjusted under 35 U.S.C. 154(b) by 398 days.

(21) Appl. No.: 13/655,730

(22) Filed: Oct. 19, 2012

(65) Prior Publication Data

US 2013/0228431 A1 Sep. 5, 2013

Related U.S. Application Data

(60) Provisional application No. 61/606,250, filed on Mar. 2, 2012.

(51) Int. Cl.

| | |
|---|---|
| ***H01H 31/02*** | (2006.01) |
| ***H01H 31/28*** | (2006.01) |
| ***H01H 31/32*** | (2006.01) |
| ***H01H 9/22*** | (2006.01) |
| ***H01R 13/447*** | (2006.01) |
| ***H01R 13/453*** | (2006.01) |
| ***H01R 13/70*** | (2006.01) |

(52) U.S. Cl.

CPC ..... *H01R 13/447* (2013.01); *H01H 9/22* (2013.01); *H01R 13/4538* (2013.01); *H01R 13/701* (2013.01); *H01R 2201/26* (2013.01)

(58) Field of Classification Search

USPC ... 200/48 R, 48 P, 48 A, 48 KB, 48 V, 48 SB, 200/48 CB, 345, 329–332, 319–323, 200/333–336, 293

See application file for complete search history.

(56) References Cited

U.S. PATENT DOCUMENTS

| | | | | |
|---|---|---|---|---|
| 4,622,443 | A * | 11/1986 | Mooz | 200/50.01 |
| 2003/0057849 | A1 | 3/2003 | Pruett et al. | |
| 2004/0266235 | A1 | 12/2004 | Saethre et al. | |
| 2005/0041354 | A1 | 2/2005 | Pruett et al. | |
| 2013/0337705 | A1 | 12/2013 | Kalayjian et al. | |

* cited by examiner

*Primary Examiner* — Edwin A. Leon
*Assistant Examiner* — Anthony R. Jimenez
(74) *Attorney, Agent, or Firm* — J. Richard Soderberg

(57) ABSTRACT

A high voltage (HV) interface housing is provided that includes an assembly of levers within the housing that detect whether or not the HV lines are coupled to the interface housing. If the HV lines are not in place, the lever assembly prevents the interface cover from being fully installed onto the interface housing, thereby preventing the HV interlock loop switch from being closed. As a result, when the HV cables are not in place, the HV interlock loop switch prevents power from being applied to the HV circuit. If, however, the HV lines are properly positioned within the interface housing, the levers of the lever assembly automatically retract, thus allowing the interface cover to be fully installed onto the interface housing. In this state, the interface cover closes the HV interlock loop switch, thus closing the HV interlock loop and allowing power to be applied to the HV circuit.

20 Claims, 7 Drawing Sheets

ELECTRICAL INTERFACE INTERLOCK SYSTEM

CROSS-REFERENCE TO RELATED APPLICATION

This application claims the benefit of the filing date of U.S. Provisional Patent Application Ser. No. 61/606,250, filed 2 Mar. 2012, the disclosure of which is incorporated herein by reference for any and all purposes.

FIELD OF THE INVENTION

The present invention relates generally to electrical systems and, more particularly, to an electrical interface interlock.

BACKGROUND OF THE INVENTION

In a conventional high voltage (HV) electrical interface, accidental exposure to the high voltage lines, for example by assembly or service personnel, is prevented through the use of an interface lid switch that detects the presence of the interface cover. If the interface cover is not in place and the interface module is open, the lid switch prevents power from being applied to the HV circuit. Unfortunately if the HV cables have not been installed, but the interface cover is in place, the lid switch will allow power to be applied to the HV circuit, resulting in an unsafe condition to exist due to the uninstalled and exposed HV cables. Accordingly, what is needed is a HV electrical interface that prevents the occurrence of such a condition. The present invention provides such an interface.

SUMMARY OF THE INVENTION

A high voltage (HV) interface module is provided that includes at least one, and preferably two, HV interconnects that are used to electrically connect at least one, and preferably two, HV lines to at least one, and preferably two, HV outputs. The HV interface module also includes an assembly of levers within the module's housing that detect whether or not the HV lines are coupled to the interface housing. If the HV lines are not in place, the lever or levers comprising the lever assembly prevent the housing cover from being fully installed onto the housing assembly, thereby preventing the HV interlock loop switch from being closed. As a result, when the HV lines are not in place, the HV interlock loop switch prevents power from being applied to the HV circuit. If, however, the HV lines are properly positioned within the interface housing, the levers of the lever assembly automatically retract, thus allowing the interface cover to be fully installed onto the interface housing. In this state, the interface cover closes the HV interlock loop switch, thus closing the HV interlock loop and allowing power to be applied to the HV circuit.

A further understanding of the nature and advantages of the present invention may be realized by reference to the remaining portions of the specification and the drawings.

DESCRIPTION OF THE SPECIFIC EMBODIMENTS

The high voltage (HV) interface housing described and shown herein includes an assembly of levers within the housing that detect whether or not the HV lines are properly positioned within the interface housing. If the HV lines are not in place, the lever assembly prevents the interface cover from being attached and fully installed onto the interface housing, thereby preventing the HV interlock loop switch from being depressed and closing the switch. As a result, when the HV lines are not in place, the HV interlock loop switch prevents power from being applied to the HV circuit. If, however, the HV lines are properly positioned within the interface housing, the levers of the lever assembly automatically retract, thus allowing the interface cover to be properly positioned and fully installed onto the interface housing. In this state, the interface cover depresses and closes the HV interlock loop switch, thus closing the HV interlock loop and allowing power to be applied to the HV circuit.

Figure 1:
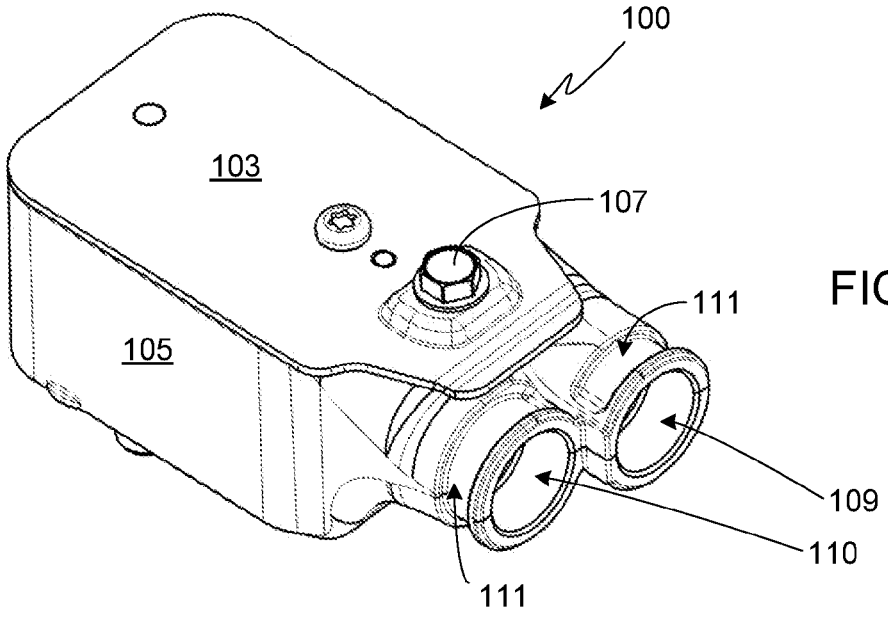
FIG. 1 provides a front perspective view of the HV interface module of the invention with the housing cover in place.
Figure 2:
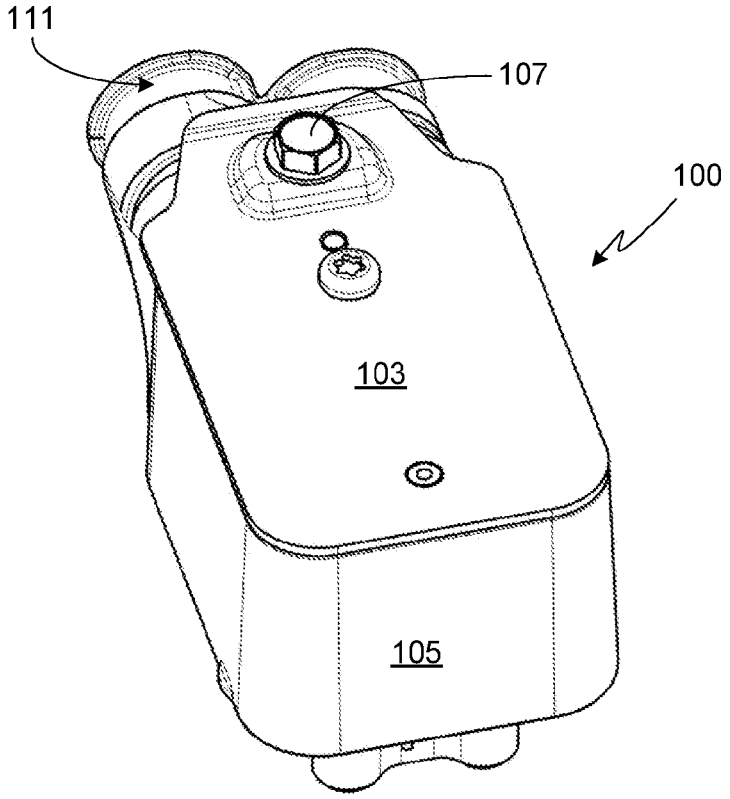
FIG. 2 provides a rear perspective view of the HV interface module shown in FIG. 1.

FIGS. 1 and 2 provide two different perspective views of a preferred embodiment of an HV interface module 100 in accordance with the invention. In these views module 100 is not shown attached to a device, nor is the module shown with connected wires or a wiring harness. It will be appreciated that the lever assembly and interlock system described in detail herein may be embodied in other housing configurations without departing from the essential design characteristics of the invention.

In FIGS. 1 and 2, the interface cover assembly 103 is shown loosely attached to housing 105 and held in place via bolt 107, interface cover assembly 103 being used to cover, close and seal the primary access port of housing 105. In FIGS. 1 and 2 cover assembly is not fully installed on the housing, rather a small gap is left between the mating surfaces of the cover and housing assemblies that prevents the HV interlock switch from being closed. Note that the gap between the cover and housing assemblies is not clearly evident in the views provided by FIGS. 1 and 2. As described in detail below, an internally mounted lever assembly prevents full installation of the cover assembly onto the housing if the HV cables are not present. The HV cables, when mounted, are installed through cable ports 109/110. Note that in this embodiment of the interface module two HV lines, e.g., a positive line and a negative line, are connected to two outgoing lines. It should be understood that the same lever assembly used to prevent HV interlock switch depression prior to complete interface assembly may also be used in an interface module configured to connect only a single HV line, or more than the two HV lines. When more than two HV lines are present, preferably a lever corresponding to each HV line is also present, as described in detail below, although it is possible to use a single lever with multiple HV lines where the lever corresponds to only one of the HV lines. Preferably each cable port 109/110 includes means of locking the HV cables, not shown, to the interface module 100, thus minimizing mechanical stresses applied to the lugs within the assembly. In the illustrated embodiment, each cable port includes a recessed collar 111 that may be used for this purpose.

Figure 3:
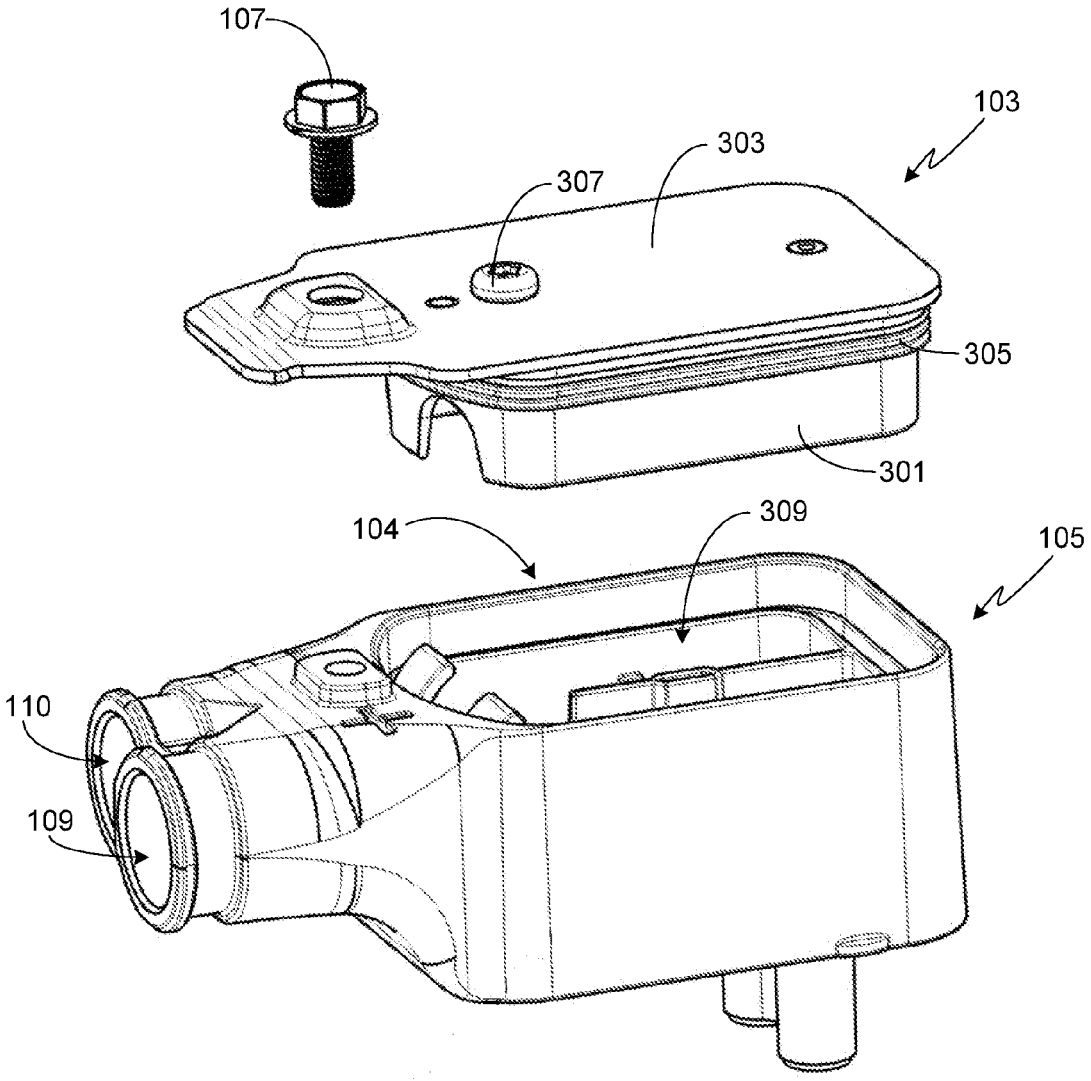
FIG. 3 provides a perspective view of the HV interface module of FIGS. 1 and 2 with the cover assembly displaced from the housing assembly.

FIG. 3 provides a perspective view of interface module 100 with the cover assembly 103 displaced from the housing assembly 105, thus showing the primary access port 104. In the preferred and illustrated embodiment, cover assembly 103 is comprised of four primary components: an electrically insulating member 301, a rigid lid member 303, a seal 305, and a bolt 307 that holds the cover assembly together. In this view, the components comprising housing assembly 105 are not clearly shown, although the upper portion of lever assembly 309 is visible.

The external surfaces of the side walls of member 301 are preferably configured to be complementary to the side walls of lever assembly 309, and designed to fit within the sidewalls of the external housing of housing assembly 105, thus improving the electrical isolation of the HV lines and HV interconnects contained therein. The lower surface of lid member 303 is mated to a complementary upper surface of member 301. In at least one embodiment, lid member 303 is fabricated from a metal, e.g., aluminum, since it is not required to be non-conducting given the placement of insulating member 301. Seal 305 provides a water tight seal between cover assembly 103 and housing assembly 105 and as such is preferably fabricated from an elastomeric material such as natural rubber or a synthetic rubber (e.g., nitrile, nitrile butadiene, carborylated nitrile, hydrogenated nitrile, perfluoroelastomer, silicone, silicone elastomer blends, thermoplastic elastomers, fluorosilicone, neoprene, ethylene propylene, polyurethane, butyl and ethylene propylene diene monomer). When the cover assembly 103 is completely installed onto the housing assembly 105, seal 305 is partially compressed and deformed, thereby forming a water tight seal.

Figure 4:
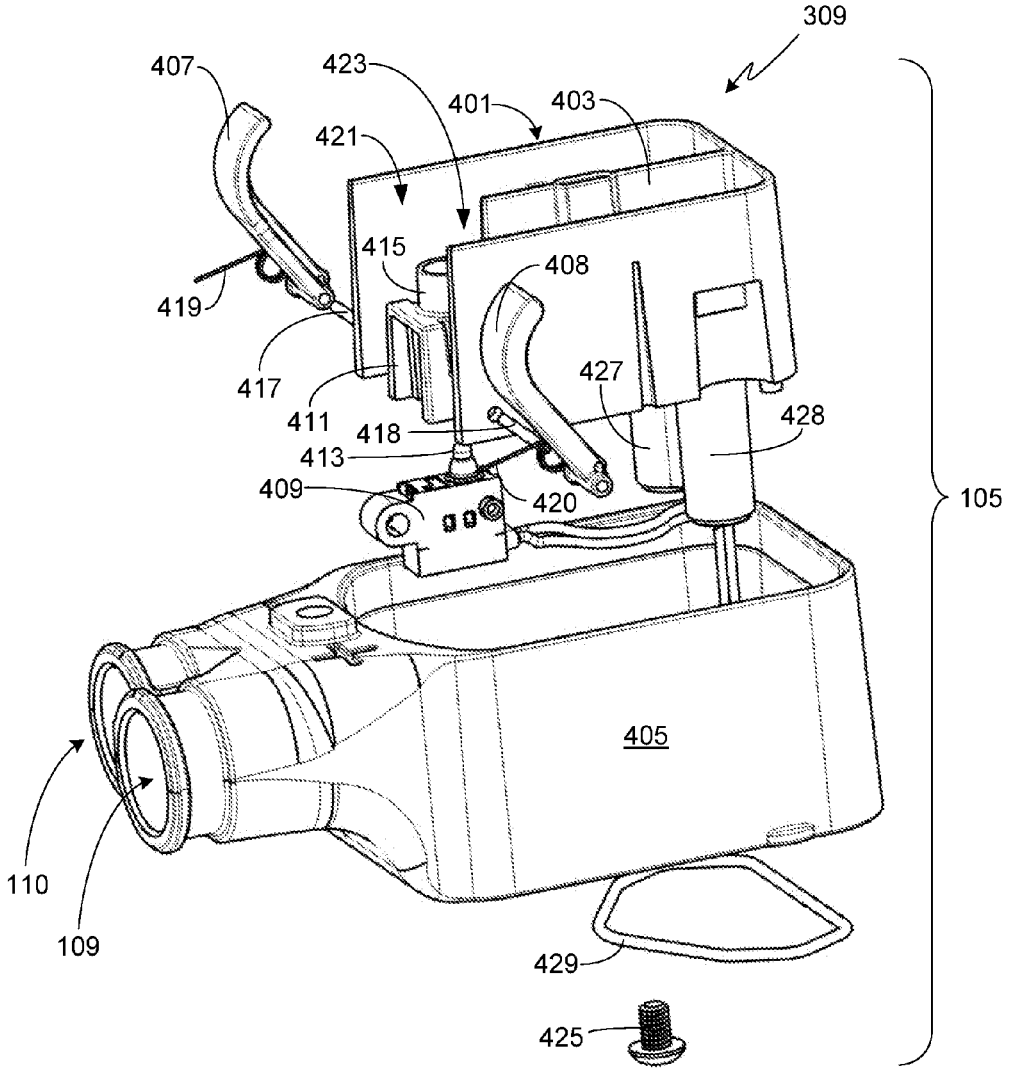
FIG. 4 provides a first perspective, exploded view of the HV module housing assembly.
Figure 5:
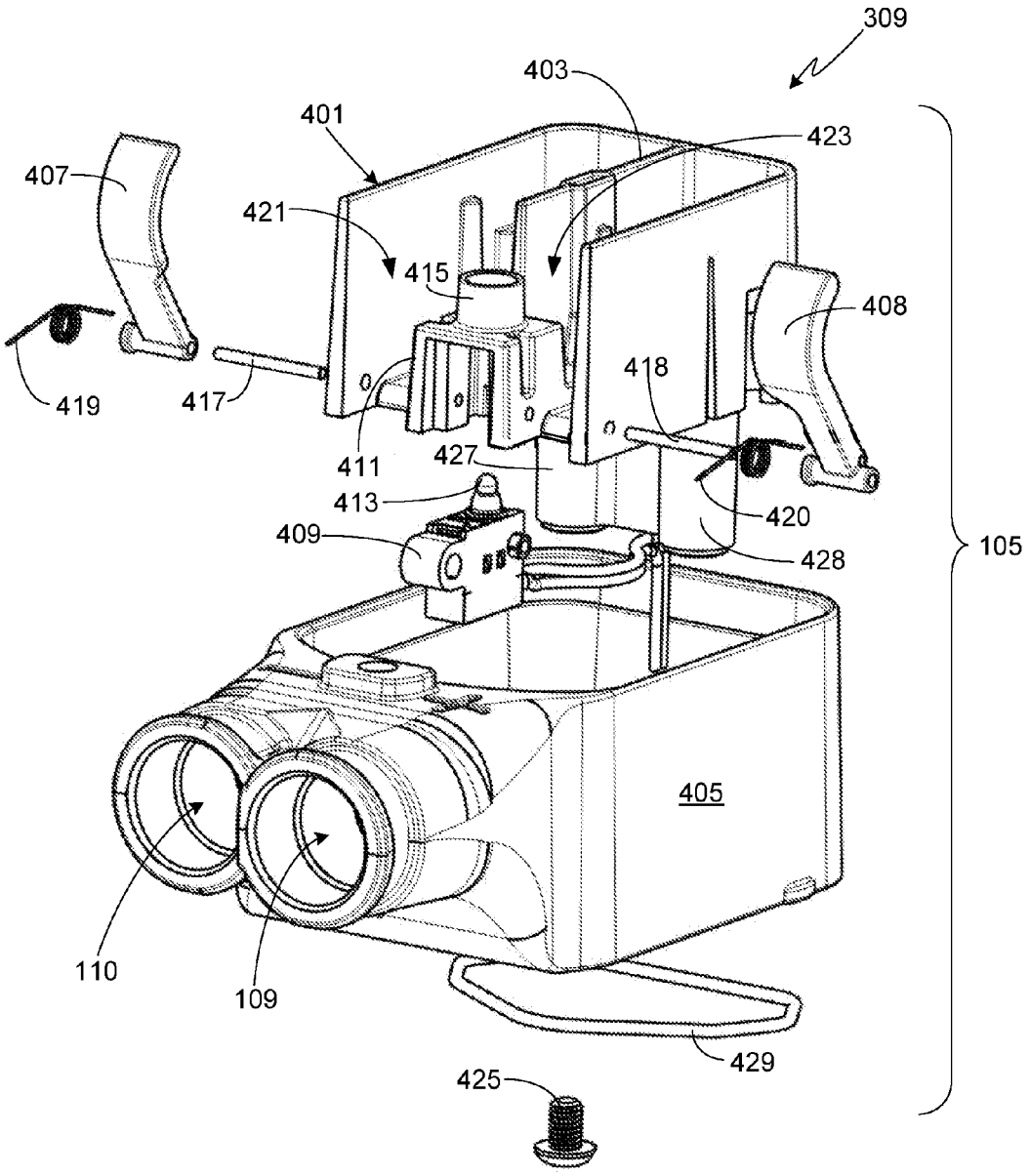
FIG. 5 provides a second perspective, exploded view of the HV module housing assembly.

FIGS. 4 and 5 provide two different perspectives of an exploded view of housing assembly 105. Within housing assembly 105 is the lever assembly 309. Lever assembly includes an HV isolation module 401 that is used to insure segregation of the two HV lines, not shown, as well as the HV connectors. To this end, HV isolation module 401 includes a partition wall 403 that provides further electrical isolation between the HV line terminals, described in detail below. HV isolation module 401, including its various structural elements such as partition wall 403, is fabricated from an electrically insulating material such as an electrically insulating plastic (e.g., polyethylene, polypropylene, polystyrene, polyvinyl chloride, polytetrafluoroethylene, etc.). Similar materials are used for the other electrically non-conducting components of interface module 100 (e.g., lid member 301, outer housing 405, levers 407/408, etc.).

HV isolation module 401 includes means for mounting the HV interlock switch 409. Switch 409 may be a simple mechanical switch, for example a mechanical switch with a plunger 413 as shown and preferred, or a reed switch, hall effect switch, shorting jumper, or other type of switch. In the preferred and illustrated embodiment, module 401 includes a compartment 411 into which HV interlock switch 409 is mounted. Switch plunger 413 preferably extends through a collar 415 in compartment 411, collar 415 helping to guide a complementary feature, e.g., a protrusion, located on the inner surface of lid member 301 during interface module assembly. As previously noted, if the HV lines are properly positioned within module 100, thereby depressing levers 407/408, the protrusion on the inner surface of the lid assembly 103 will depress HV interlock switch plunger 413, thereby closing the switch and allowing power to be applied to the HV circuit.

Levers 407 and 408 rotate about pins 417 and 418, respectively. Springs 419/420 place levers 407/408 under tension in order to insure that the levers are maintained in an upright position, as shown in FIGS. 3-5, unless they are depressed by the HV lines (not shown). In their upright positions (i.e., towards the housing opening), levers 407 and 408 prevent lid assembly 105 from being fully closed and fully installed on housing assembly 105, thus preventing the HV interlock switch button 413 from being depressed. It should be understood that while levers 407 and 408 are shown located outside of HV isolation module 401 in FIGS. 4 and 5, this is due to the nature of the exploded view. After assembly, and as illustrated in subsequent figures, lever 407 is positioned at location 421 between an interior surface of module 401 and switch compartment 411, and directly in the pathway of the HV line that passes through port 110. Similarly, lever 408 is positioned at location 423 between an interior surface of module 401 and switch compartment 411, and directly in the pathway of the HV line that passes through port 109. Note that in this embodiment bolt 425 holds the HV isolation module 401 within outer housing 405.

Figure 6:
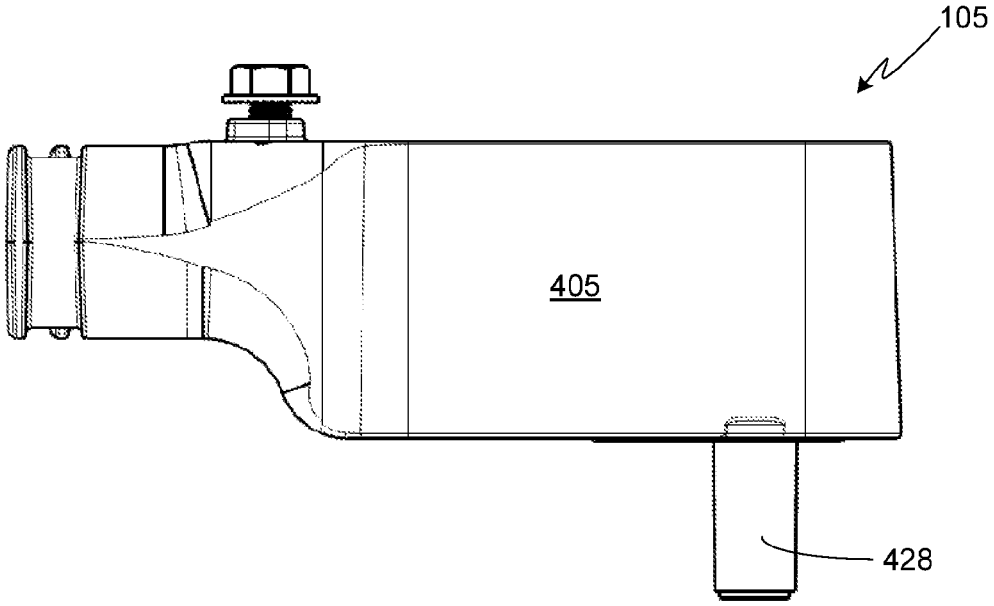
FIG. 6 provides an external, side view of the HV module housing assembly.
Figure 7:
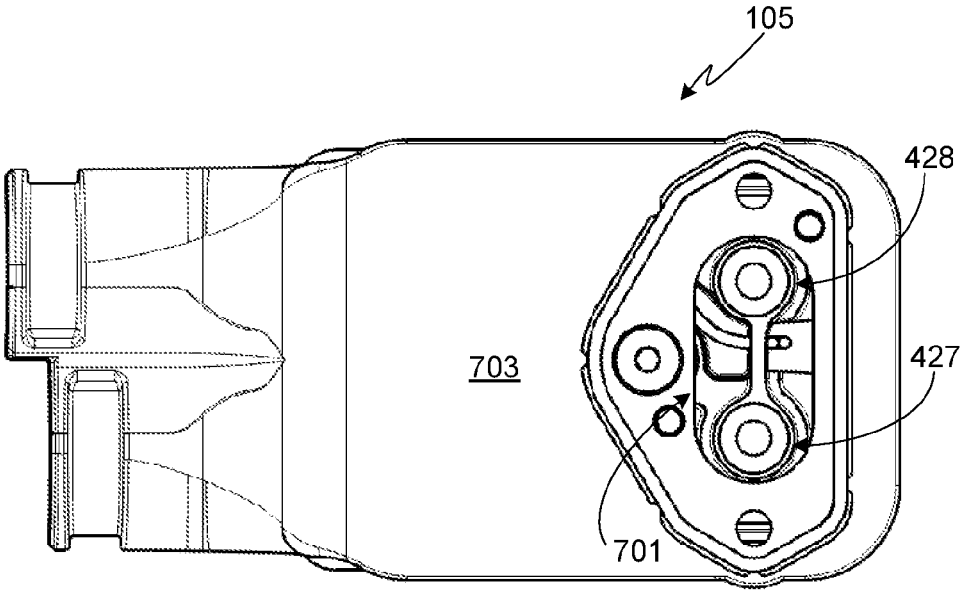
FIG. 7 provides an external, bottom view of the HV module housing assembly.

FIGS. 6 and 7 provide external side and bottom views, respectively, of assembled housing assembly 105. In the preferred and illustrated embodiment, HV isolation module 401 includes a pair of HV interconnects 427/428 that extend through an aperture 701 in the bottom surface 703 of outer housing 405. In this configuration interface module 100 is configured to mount directly to an HV component, such as a DC/DC converter, thus allowing the interconnects 427/428 to be coupled to the HV lines of the other component. It will be appreciated, however, that the interface interlock system of the present invention may be used in other configurations. HV housing assembly 105 is sealed to the other HV component using seal 429, seal 429 being fabricated from a suitable elastomeric material such as natural rubber or a synthetic rubber (e.g., nitrile, nitrile butadiene, carborylated nitrile, hydrogenated nitrile, perfluoroelastomer, silicone, silicone elastomer blends, thermoplastic elastomers, fluorosilicone, neoprene, ethylene propylene, polyurethane, butyl and ethylene propylene diene monomer).

Figure 8:
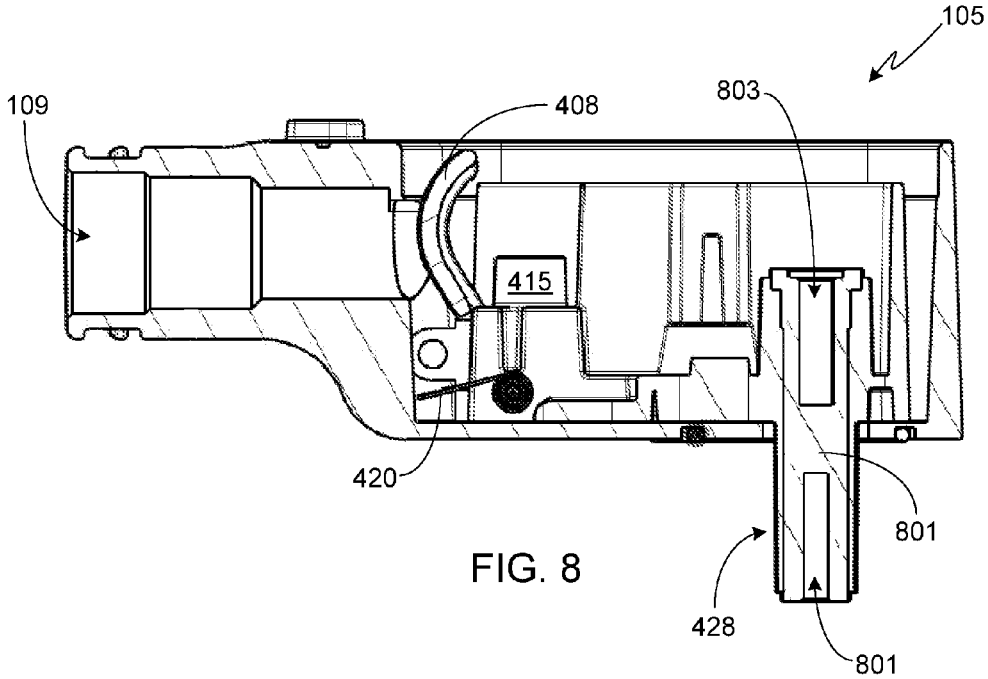
FIG. 8 provides a cross-sectional view of the HV module housing assembly, the illustrated view taken through one of the HV interconnects.
Figure 9:
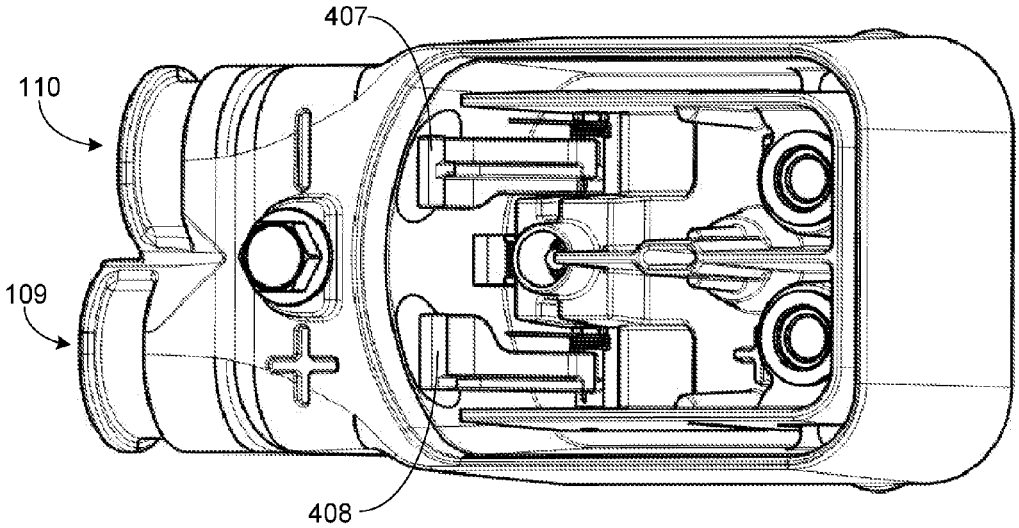
FIG. 9 provides an alternate perspective view of the HV module housing assembly.

FIG. 8 provides a cross-sectional view of housing assembly 105, the illustrated view taken through one of the HV interconnects, specifically interconnect 428. It should be understood that the cross-section through the second interconnect 427 would be similar, if not identical. Within the non-conducting interconnect housing is an electrically conductive insert 801, insert 801 preferably fabricated from copper. The upper portion 803 of insert 801 is preferably bored and tapped, thus allowing the terminal of a HV line passing through cable port 109 to be bolted to the interconnect. Preferably the lower portion 805 of insert 801 is also bored and tapped to provide a convenient means of coupling the HV interconnect to the intended HV component. Note that in this view it is clear that lever 408 blocks cable port 109, in the same way as lever 407 blocks cable port 110. Lever 408 is held in this position by spring 420. Similarly, lever 407 is held in the blocking position by spring 419. FIG. 9 provides an alternate view of housing assembly 105, illustrating the positioning of levers 407/408 relative to cable ports 110/109. In this position, and as previously noted, the levers prevent the lid assembly 103 from being fully installed on the housing assembly 105, thereby preventing depression of HV interlock switch plunger 413. As a result, when the HV lines do not pass through the cable ports, levers 407/408 prevent the HV interlock loop from being closed and therefore insure that power cannot be applied to the HV circuit.

Figure 10:
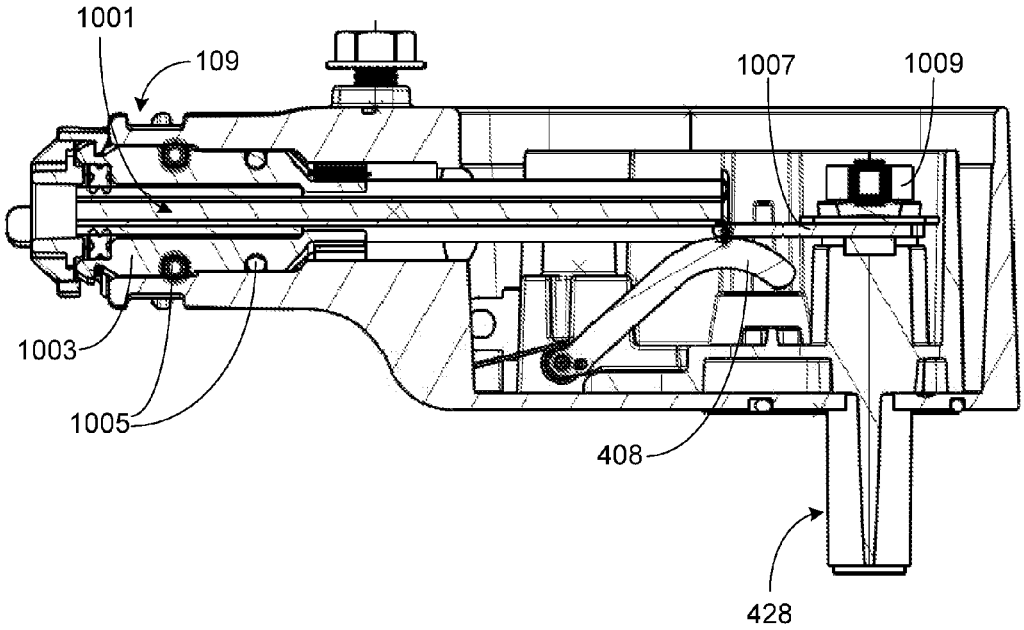
FIG. 10 provides a cross-sectional view of the HV module housing assembly, similar to that provided by FIG. 8, with the inclusion of a HV line.

FIG. 10 provides a cross-sectional view of housing assembly 105, similar to that provided in FIG. 8 except for the inclusion of HV line 1001. Note that the cable for HV line 1001 is not shown, rather just the end portion of the line that extends into the HV module is shown. The outer jacket 1003 of HV line 1001 is preferably sealed to housing assembly 105, and more specifically to the inner surface of cable port 109, for example using multiple O-rings 1005. In this embodiment, a lug 1007 terminates HV line 1001, lug 1007 tied to the copper insert within interconnect 428 using screw 1009. Note that in this view, due to the inclusion of HV line 1001, lever 408 is downwardly depressed. As a result, lever 408 no longer blocks installation of the lid assembly 103 from being fully installed on housing assembly 105, thus allowing depression and activation of the HV interlock switch 409.

It should be understood that the accompanying figures are only meant to illustrate, not limit, the scope of the invention and should not be considered to be to scale.

Systems and methods have been described in general terms as an aid to understanding details of the invention. In some instances, well-known structures, materials, and/or operations have not been specifically shown or described in detail to avoid obscuring aspects of the invention. In other instances, specific details have been given in order to provide a thorough understanding of the invention. One skilled in the relevant art will recognize that the invention may be embodied in other specific forms, for example to adapt to a particular system or apparatus or situation or material or component, without departing from the spirit or essential characteristics thereof. Therefore the disclosures and descriptions herein are intended to be illustrative, but not limiting, of the scope of the invention.

What is claimed is:

1. A high voltage (HV) interface module, comprising:

a housing assembly, said housing assembly comprising:

an access port;

at least a first HV cable port configured to accept a first HV line; and at least a first HV interconnect configured to couple said first HV line to a first HV module output, wherein said first HV interconnect is accessible via said access port;

a housing cover configured to mate to said housing assembly and to cover and close said access port;

a lever assembly mounted within said housing assembly, said lever assembly comprising:

at least a first lever, said first lever configured to travel between a first position and a second position, wherein said first lever in said first position at least partially blocks said first HV cable port, wherein said first lever in said first position prevents said housing cover from completely closing said access port and prevents complete installation of said housing cover on said housing assembly, wherein said first lever in said second position allows said housing cover to completely close said access port and allows complete installation of said housing cover on said housing assembly, and wherein said first HV line passing through said first HV cable port moves said first lever from said first position to said second position; and at least a first spring member, said first spring member configured to apply tension to said first lever to preferentially hold said first lever in said first position; and an HV interlock switch coupled to an HV circuit, said HV interlock switch having an open position and a closed position, wherein said HV interlock switch in said open position prevents power from being applied to said HV circuit, wherein said HV interlock switch in said closed position allows power to be applied to said HV circuit, wherein said HV interlock switch is in said open position when said access port is uncovered, and wherein said HV interlock switch is modified from said open position to said closed position when said housing cover completely closes said access port.

2. The HV interface module of claim 1, said housing assembly further comprising:

a second HV cable port configured to accept a second HV line; and a second HV interconnect configured to couple said second HV line to a second HV module output, wherein said second HV interconnect is accessible via said access port.

3. The HV interface module of claim 2, said lever assembly further comprising:

a second lever, said second lever configured to travel between a first position and a second position, wherein said second lever in said first position at least partially blocks said second HV cable port, wherein said second lever in said first position prevents said housing cover from completely closing said access port and prevents complete installation of said housing cover on said housing assembly, wherein said second lever in said second position allows said housing cover to completely close said access port and allows complete installation of said housing cover on said housing assembly, and wherein said second HV line passing through said second HV cable port moves said second lever from said first position to said second position; and at least a second spring member, said second spring member configured to apply tension to said second lever to preferentially hold said second lever in said first position.

4. The HV interface module of claim 1, wherein said first lever is configured to rotate about a mounting pin, wherein when said first HV line is inserted through said first HV cable port said first HV line rotates said first lever about said mounting pin from said first position to said second position.

5. The HV interface module of claim 1, wherein said HV interlock switch further comprises a plunger, wherein an inner surface of said housing cover depresses said plunger when said housing cover completely closes said access port and said housing cover is completely installed on said housing assembly, wherein said HV interlock switch is in said open position when said plunger is un-depressed, and wherein said HV interlock switch is in said closed position when said plunger is depressed by said inner surface of said housing cover when said housing cover completely closes said access port and said housing cover is completely installed on said housing assembly.

6. The HV interface module of claim 5, wherein said housing cover further comprises a protrusion on said inner surface that depresses said plunger when said housing cover completely closes said access port and said housing cover is completely installed on said housing assembly.

7. The HV interface module of claim 1, wherein said first HV module output extends through a secondary port within said housing assembly, said secondary port configured to mate to a secondary HV device.

8. The HV interface module of claim 7, further comprising a sealing member, said sealing member configured to provide a water tight seal between said housing assembly and said secondary HV device.

9. The HV interface module of claim 8, said sealing member fabricated from a material selected from the group consisting of natural rubber, nitrile, nitrile butadiene, carborylated nitrile, hydrogenated nitrile, perfluoroelastomer, silicone, silicone elastomer blends, thermoplastic elastomers, fluorosilicone, neoprene, ethylene propylene, polyurethane, butyl and ethylene propylene diene monomer.

10. The HV interface module of claim 1, wherein said housing assembly is fabricated from an electrically non-conducting plastic.

11. The HV interface module of claim 1, wherein said housing cover is fabricated from an electrically non-conducting plastic.

12. The HV interface module of claim 1, wherein said housing cover forms a water tight seal when said housing cover completely closes said access port and is completely installed on said housing assembly.

13. The HV interface module of claim 1, wherein said housing cover further comprises a sealing member, wherein said sealing member forms a water tight seal between said housing cover and said housing assembly when said housing cover completely closes said access port and is completely installed on said housing assembly.

14. The HV interface module of claim 13, said sealing member fabricated from a material selected from the group consisting of natural rubber, nitrile, nitrile butadiene, carborylated nitrile, hydrogenated nitrile, perfluoroelastomer, silicone, silicone elastomer blends, thermoplastic elastomers, fluorosilicone, neoprene, ethylene propylene, polyurethane, butyl and ethylene propylene diene monomer.

15. The HV interface module of claim 1, further comprising an electrically conductive insert mounted within said first HV interconnect.

16. The HV interface module of claim 15, wherein said electrically conductive insert is fabricated from copper.

17. The HV interface module of claim 1, wherein said first lever in said first position allows said housing cover to partially close said access port while preventing complete installation of said housing cover on said housing assembly.

18. The HV interface module of claim 1, said first HV cable port further comprising a recessed collar for locking said first HV line into said first HV cable port.

19. The HV interface module of claim 1, said housing cover further comprising an outer lid member coupled to said housing cover, wherein said housing cover is fabricated from an electrically non-conducting plastic and said lid member is fabricated from a metal.

20. The HV interface module of claim 1, said housing assembly further comprising an HV isolation module, wherein said lever assembly is mounted to said HV isolation module, and wherein said first HV interconnect is coupled to said HV isolation module.

* * * * *